US007222662B2

(12) United States Patent
Neumann

(10) Patent No.: US 7,222,662 B2
(45) Date of Patent: May 29, 2007

(54) HEAT EXCHANGER FOR A REFRIGERATOR AND METHOD FOR THE PRODUCTION OF A HEAT EXCHANGER

(75) Inventor: Michael Neumann, Ulm (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/973,694

(22) Filed: Oct. 26, 2004

(65) Prior Publication Data

US 2005/0121183 A1 Jun. 9, 2005

Related U.S. Application Data

(63) Continuation of application No. PCT/EP03/04337, filed on Apr. 25, 2003.

(30) Foreign Application Priority Data

Apr. 26, 2002 (DE) ..... 202 19 130 U
Dec. 20, 2002 (DE) ..... 102 60 165

(51) Int. Cl.
*F28F 13/18* (2006.01)

(52) U.S. Cl. ..... 165/133; 165/168; 165/171

(58) Field of Classification Search ..... None
See application file for complete search history.

(56) References Cited

U.S. PATENT DOCUMENTS 1,982,075 A 11/1934 Smith
2,014,837 A * 9/1935 Daemicke ..... 62/77
2,124,110 A 7/1938 Hall
2,276,811 A 3/1942 Ward
2,489,754 A 11/1949 Crider
3,912,005 A 10/1975 Griffiths
4,201,193 A * 5/1980 Ronc ..... 126/623

FOREIGN PATENT DOCUMENTS

| | | | |
|---|---|---|---|
| DE | 198 18 995 | A1 | 11/1999 |
| DE | 199 38 773 | A1 | 2/2001 |
| EP | 0 697 277 | A2 | 2/1996 |
| EP | 0 806 617 | A2 | 11/1997 |
| JP | 54132845 | A | 10/1979 |
| JP | 57210295 | A | 12/1982 |

* cited by examiner

*Primary Examiner*—Leonard R. Leo
(74) *Attorney, Agent, or Firm*—Russell W. Wamock; Craig J. Loest

(57) ABSTRACT

A heat exchanger for a refrigerator contains a base plate, a conduit for a cooling agent, which is disposed such that the conduit is in heat-conducting contact with the base plate, and a layer of holding material. The layer of holding material adheres to the base plate and the conduit and is made of a bitumen composition. The heat exchanger is produced by stacking the base plate, the conduit, and a sheet made of the bitumen composition. The layer of holding material is formed from the sheet by heating and pressing the stack.

11 Claims, 2 Drawing Sheets

HEAT EXCHANGER FOR A REFRIGERATOR AND METHOD FOR THE PRODUCTION OF A HEAT EXCHANGER

CROSS-REFERENCE TO RELATED APPLICATION

This is a continuing application, under 35 U.S.C. § 120, of copending international application No. PCT/EP03/04337, filed Apr. 25, 2003, which designated the United States; this application also claims the priority, under 35 U.S.C. § 119, of German patent applications No. 202 19 130.3, filed Apr. 26, 2002 and No. 102 60 165.8, filed Dec. 20, 2002; the prior applications are herewith incorporated by reference in their entirety.

BACKGROUND OF THE INVENTION

Field of the Invention

The present invention relates to a heat exchanger, such as an evaporator, a condenser or the like, for a refrigerator with a base plate, a pipeline for a refrigerant, disposed in heat-conducting contact with the base plate, and a layer of holding material, adhering to the base plate and the pipeline, and also to a method for the production of such a heat exchanger.

A heat exchanger of this type and a method for its production are known from Published, Non-Prosecuted German Patent Application DE 199 38 773 A1. In the case of the known production method, a pipeline that is bent in a meandering manner is held pressed against a base plate, and the intermediate spaces between the meanders of the pipeline are each filled with a holding device. The holding device may be expanded polyurethane foam or else a pourable thermosetting plastic. Such holding devices are costly, and the cross-linking that takes place while they are curing or expanding makes it difficult for them to be recovered and reused if such a heat exchanger is to be recycled.

SUMMARY OF THE INVENTION

It is accordingly an object of the invention to provide a heat exchanger for a refrigerator and a method for the production of a heat exchanger which overcome the above-mentioned disadvantages of the prior art devices and methods of this general type, which is an inexpensive to manufacture and can be easily recycled for a refrigerate.

With the foregoing and other objects in view there is provided, in accordance with the invention, a heat exchanger for a refrigerator. The heat exchanger containing a base plate, a pipeline for a refrigerant, disposed in heat-conducting contact with the base plate, and a layer of holding material adhering to the base plate and the pipeline. The layer of holding material contains a bitumen composition.

The use of a bitumen composition as the layer of holding material has the advantage that such materials are inexpensively available, and that they can be easily recycled, since the bitumen material obtained after breaking up such a heat exchanger into its component parts can be used for the production of a new heat exchanger or other purposes without any appreciable reprocessing and without loss of quality. Furthermore, use of the bitumen composition ensures after it has cooled down an intimate contact of the pipeline with the base plate, whereby the thermal efficiency of the heat exchanger is improved. The mass of the bitumen composition also has a heat-storing or cold-storing effect, which in the case of an evaporator serves the purpose of lowering the energy consumption of a refrigerator.

The connection achieved by the bitumen composition between the base plate and the pipeline can be subjected to great mechanical loads and consequently the heat exchanger is dimensionally very stable during handling in the production sequence of a mass production operation.

The conforming properties of the bitumen composition mentioned makes it follow the exact contours of the pipeline and the base plate, as a result of which no moisture can diffuse in between the pipeline and the base plate, so that a risk of corrosion or the risk of ice formation leading to detachment of the pipeline from the base plate is avoided.

In order to promote the heat transfer between the pipeline and the base plate, the pipeline may have a flattened cross section with a widened side facing the base plate, in order to ensure surface-area contact between the pipeline and the base plate. The surface-area contact ensures heat-conducting contact between the pipeline and the base plate even under unfavorable production conditions.

In order to achieve a firm connection between the layer of holding material and the base plate, a layer of adhesive which bonds the layer of holding material to the base plate at least locally may preferably be provided.

The layer of adhesive preferably contains an adhesive that can be activated by heat. This simplifies the production of the heat exchanger, since the layer of adhesive can be applied in advance in an unprotected state to a sheet of the bitumen composition used for forming the layer of holding material and since it gains its effectiveness by melting when the layer of holding material is heated.

Apart from bitumen, the bitumen composition may contain between about 50 and 80% of filler. The filler, which may be a single material or a mixture of materials, may be selected for example from the aspect of minimizing costs, improving the thermal conductivity or optimizing the heat storage capacity of the layer of holding material. A high heat storage capacity has the effect that, in a refrigerator in which the evaporator according to the invention is installed, the compressor must run for a long time before a temperature sensor attached to the evaporator senses that the temperature has dropped below the lower limiting temperature, at which the evaporator is switched off. Conversely, however, it also takes a long time after switching off the compressor before the evaporator and the storage space have warmed up again to an upper limiting temperature, which when exceeded has the effect that the compressor is switched on again. Extending the switched-on phases of the compressor while maintaining the same ratio of the duration of the switched-on phases to the overall operating time of the refrigerator improves the efficiency of the refrigerator.

Preferred fillers are comminuted stone or iron.

For protection, the layer of holding material may be provided with a layer of lacquer on its side facing away from the base plate.

The layer of holding material expediently has an average thickness in the range between 0.5 and 2 mm, preferably between 1.0 and 1.5 mm.

The production of a heat exchanger of the type described above is possible in a simple way by forming a stack that contains a base plate, a pipeline for a refrigerant and a sheet of a bitumen composition, and subsequently heating the sheet and compressing the stack.

Other features which are considered as characteristic for the invention are set forth in the appended claims.

Although the invention is illustrated and described herein as embodied in a heat exchanger for a refrigerator and a method for the production of a heat exchanger, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
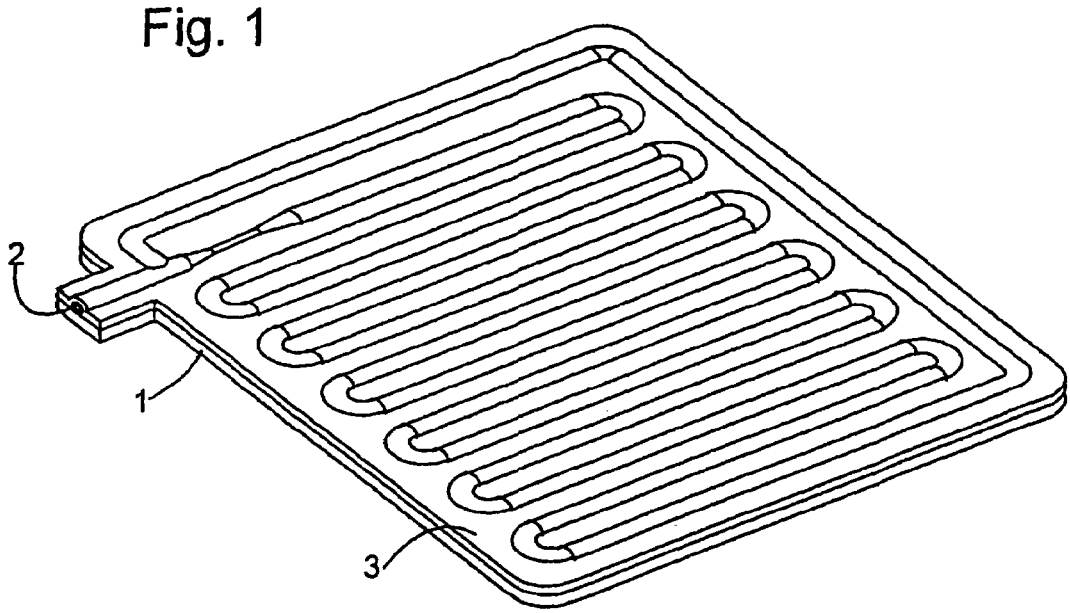
FIG. 1 is a diagrammatic, perspective view of an evaporator as an example of a heat exchanger according to the invention.

In all the figures of the drawing, sub-features and integral parts that correspond to one another bear the same reference symbol in each case. Referring now to the figures of the drawing in detail and first, particularly, to FIG. 1 thereof, there is shown a perspective view of an evaporator. The evaporator is constructed from a planar base plate 1 of aluminum sheet, on which a refrigerant line 2 containing a pipe likewise formed of aluminum is disposed in a meandering manner. The base plate 1 and the refrigerant line 2 are covered by a layer 3 of holding material of a bitumen composition.

The bitumen composition contains about 25% by weight of polymer-modified bitumen, 3% by weight of a polymer and about 72% by weight of powdered stone as a filler. Generally, the proportion of the stone is 50 to 80% by weight. Taking a density of 1100 kg/$M^3$ for bitumen and of 2800 kg/$m^3$ for the stone as a basis, this corresponds to a proportion by volume of the powdered stone of 28 to 61% by volume. Dense natural stone, which is suitable as a starting material for producing such powdered stone, typically has a heat storage coefficient S of about 700 Wh/$m^3$K, by contrast with a value of S≅515 Wh/$m^3$K for bitumen. The heat storage coefficient of the layer of holding material with 72% by weight of powdered stone (corresponding to a proportion by volume of about 50%) can be calculated as about 610 Wh/$m^3$K. The heat storage capacity of the layer of holding material 3 is consequently almost 20% higher than that of a layer of holding material of the same thickness consisting only of bitumen; at the same time, the material costs of the layer containing powdered stone are lower.

Some metals have higher heat storage coefficients than stone, such as for instance zinc (S=785 Wh/$m^3$K), copper (S=995 Wh/$m^3$K) and iron (S=1015-1080 Wh/$m^3$K). On account of its particularly high heat storage coefficient and also from aspects of cost, iron may also be considered as a filler for the layer of holding material and can be added to the bitumen with the same proportions by volume as specified above. For a holding layer with a proportion of iron of 50% by volume, a heat storage coefficient of S≅775 Wh/$m^3$K is obtained.

Figure 2:
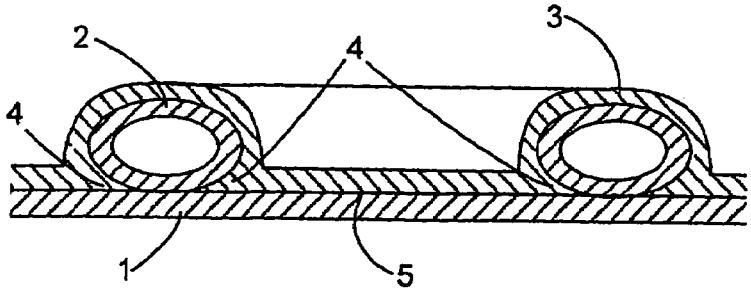
FIG. 2 is a partial sectional view through the evaporator shown in FIG. 1.

As FIG. 2 shows, the refrigerant line 2 does not have an exactly round cross section but a flattened, rather elliptical cross section, whereby the refrigerant line 2 and the base plate 1 touch each other with at least approximately surface-area contact. As a result, a heat-conducting contact is achieved between the refrigerant line 2 and the base plate 1 in a simple manner in terms of production. The layer of holding material 3 extends into interstices 4 that lie on both sides of the contact zone between the refrigerant line 2 and the plate 1. The solid layer of holding material 3 provides a better heat transfer between the base plate 1 and the refrigerant line 2 than would be possible with the conventional use of a polyurethane foam as holding material. The flattened form of the refrigerant line 2 provides a smaller thickness of the layer of holding material 3 in the interstices 4 than would be the case with a round line 2. This is likewise favorable for an efficient heat exchange between the base plate 1 and the refrigerant line 2. Between the layer of holding material 3 and the base plate 1 there is a layer 5 of a hot-melt adhesive, which, because of its much smaller thickness in comparison with the base plate 1 and the layer of holding material 3, can only be seen as a line in the figure.

Figure 3A:
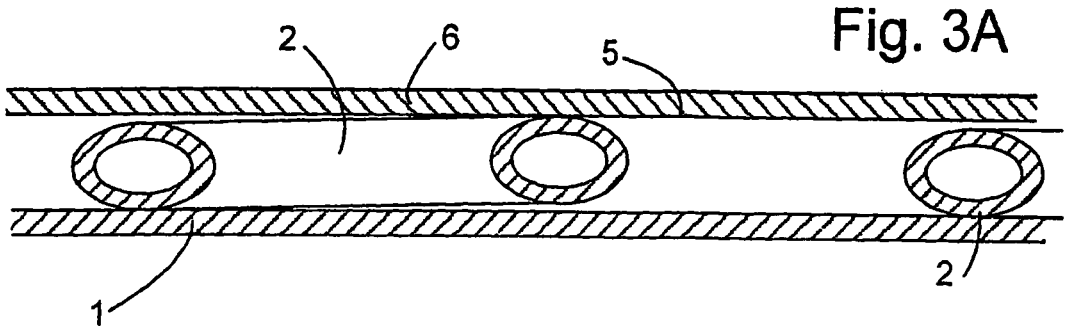
FIGS. 3A–3C are sectional views showing the steps of a method for the production of the evaporator.
Figure 3B:
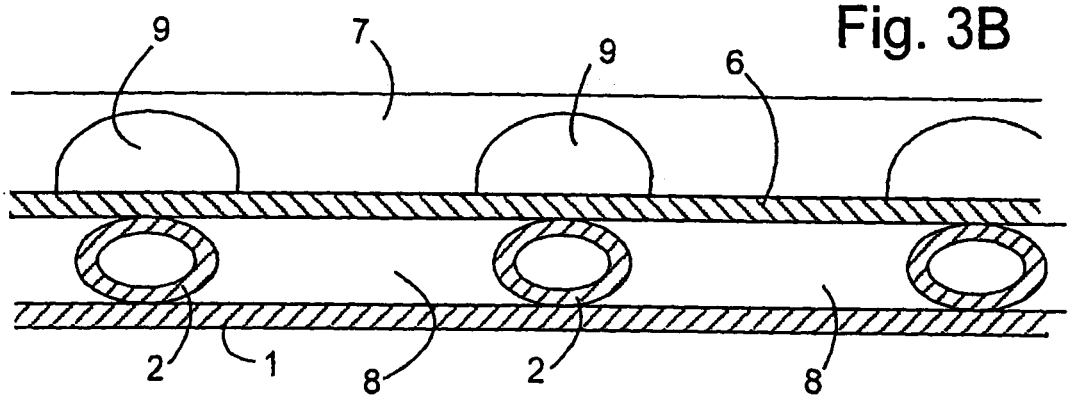
Figure 3C:
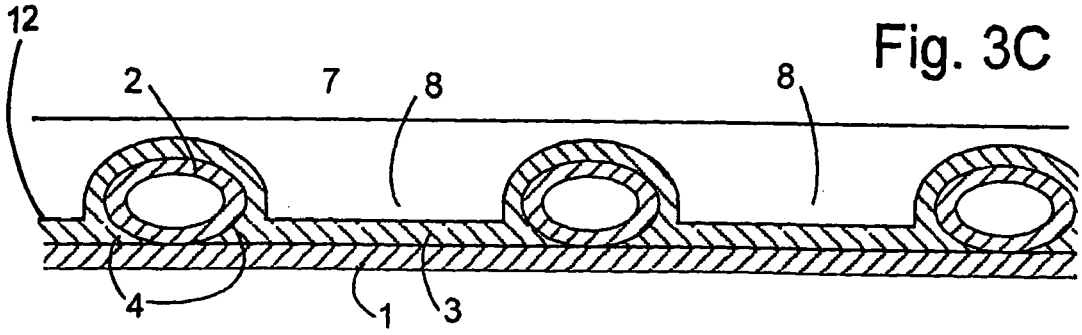

Individual steps of the production of the evaporator according to the invention are represented in FIGS. 3A–3C.

In a first method step shown in FIG. 3A, a stack is formed, the layers of which respectively contain the base plate 1, the refrigerant line 2 and a 1.2 mm thick sheet 6 of the bitumen composition. On the underside of the sheet 6 facing the base plate 1 and the refrigerant line 2 there is the layer of adhesive 5. Since the adhesive of the layer 5 does not adhere to the sheet in the cold state, the sheet 6 together with the layer 5 can be easily prefabricated and handled; measures to protect the adhesive power for the time between production and use of the sheet 6 are not necessary.

In the phase of producing the evaporator that is shown in FIG. 3A, the refrigerant line 2 does not yet have to rest on the base plate 1 over its entire length; a slight undulation of the refrigerant line 2 perpendicularly in relation to the surface of the base plate 1, as shown in FIG. 3A, is permissible.

In a second step of producing the evaporator that is shown in FIG. 3B, a die 7 is pressed against the upper side of the sheet 6. In this stage, the sheet 6 is cold and consequently rigid; the pressing force of the die 7 has the effect that the refrigerant line 2 is pressed against the base plate 1 over its entire length.

The die 7 is provided on its underside, facing the sheet 6, with channels 9, the path of which corresponds to that of the refrigerant line 2. As an alternative to this, the die 7 may be produced from elastomeric polymer, such as for example silicone with a hardness of for example 20 Shore A and a material thickness of 20 mm. In the case of a die made of elastomeric polymer with an adapted Shore hardness, so as not to cause the refrigerant line any damage, there is no need for the channel path of the refrigerant line to be introduced on the underside of the die.

Subsequent heating makes the bitumen of the sheet 6 become free-flowing, and the sheet 6 is pressed against the base plate 1 in the intermediate spaces 8 between neighboring portions of the refrigerant line 2. The viscosity of the bitumen composition is set such that on the one hand it becomes free-flowing enough to penetrate into the interstices 4 between the base plate 1 and the refrigerant line 2, but on the other hand still viscous enough to prevent parts of the refrigerant line 2 from becoming re-detached locally from the base plate 1.

To rule out the possibility of local re-detachment of the refrigerant line 2 independently of the free-flowing capability of the bitumen composition, the channels 9 of the die 7 may also be locally provided with non-illustrated projections, which are pressed through the sheet 6 when the latter is heated and come into direct contact with the refrigerant line 2 in order to keep it pressed against the base plate 1.

The melting point of the hot-melt adhesive of the layer of adhesive 5 is chosen such that it melts during the heating and shaping of the sheet 6 and so subsequently, after cooling down, bonds the re-solidified layer of holding material 3 firmly to the base plate 1 and the refrigerant line 2. The layer of adhesive 5 may extend over the entire underside of the sheet 6 or only over parts of it.

For sealing the exposed surface of the layer of holding material 3, a layer of lacquer 12, in particular of shellac, may be applied.

The recovery of the bitumen composition during recycling of the evaporator is possible in a simple way, in that the layer of holding material 3, which is brittle in the cold state, is made to come away in pieces by deforming the evaporator or in that the bond between the layer of holding material 3 and the refrigerant line 2 or base plate 1 is made to rupture by extreme cooling of the evaporator, for example with the aid of dry ice.

I claim:

1. A heat exchanger for a refrigerator, the heat exchanger comprising:

a base plate;

a pipeline for a refrigerant, disposed in heat-conducting contact with said base plate;

a layer of holding material adhering to said base plate and said pipeline, said layer of holding material containing a bitumen composition; and a layer of adhesive bonding said layer of holding material to said base plate.

2. The heat exchanger according to claim 1, wherein said pipeline has a flattened cross section.

3. The heat exchanger according to claim 1, wherein said layer of adhesive contains an adhesive that can be activated by heat.

4. The heat exchanger according to claim 1, further comprising a layer of lacquer disposed on said layer of holding material on a side facing away from said base plate.

5. The heat exchanger according to claim 1, wherein said layer of holding material has an average thickness of between 1.0 and 1.5 mm.

6. The heat exchanger according to claim 1, wherein said bitumen composition contains a filler.

7. The heat exchanger according to claim 6, wherein said filler has a higher heat storage coefficient than bitumen in said bitumen composition.

8. The heat exchanger according to claim 6, wherein said bitumen composition contains between 50 and 80% by weight of said filler.

9. The heat exchanger according to claim 6, wherein said bitumen composition contains between 25 and 65% by volume of said filler.

10. The heat exchanger according to claim 6, wherein said filler contains comminuted stone.

11. The heat exchanger according to claim 6, wherein said filler contains iron.

* * * * *